United States Patent [19]

O'Brien

[11] 4,311,312

[45] Jan. 19, 1982

[54] ELASTIC CORD SUSPENDED GOLF PRACTICE PAD

[76] Inventor: John P. O'Brien, 175 E. Delaware Pl., Chicago, Ill. 60611

[21] Appl. No.: 195,403

[22] Filed: Oct. 9, 1980

Related U.S. Application Data

[63] Continuation-in-part of Ser. No. 35,605, Apr. 26, 1979, abandoned, which is a continuation-in-part of Ser. No. 932,563, Aug. 10, 1978, abandoned.

[51] Int. Cl.[3] ..... A63B 69/36

[52] U.S. Cl. ..... 273/195 A; 273/187 A

[58] Field of Search ..... 273/195 R, 195 A, 197 A, 273/197 R, 198, 186 R, 186 C, 200 B; 272/136, 65

[56] References Cited

U.S. PATENT DOCUMENTS

| | | | |
|---|---|---|---|
| 1,276,775 | 8/1918 | Lambert | 273/195 R X |
| 2,370,990 | 3/1945 | Nissen | 272/65 |
| 3,047,294 | 7/1962 | Maxwell | 272/65 |
| 3,345,073 | 10/1967 | Hoffman | 273/197 A |
| 3,415,515 | 12/1968 | Otto | 272/136 X |
| 3,423,096 | 1/1969 | Tone | 273/195 A |
| 4,130,283 | 12/1978 | Lindquist | 273/195 A |

*Primary Examiner*—George J. Marlo

*Attorney, Agent, or Firm*—Cook, Wetzel & Egan, Ltd.

[57] ABSTRACT

A pad of synthetic grass is slidably mounted within a rectangular frame by resilient members which connect the front and rear portions of the pad to the frame. The pad is adapted to slide on a horizontal surface, and return to its original position when a golf ball is struck therefrom. The resilient members may be cloth covered rubber cords which are attached to a center portion of the frame by a pivotedly mounted pulley.

12 Claims, 7 Drawing Figures

ELASTIC CORD SUSPENDED GOLF PRACTICE PAD

The present application is a continuation-in-part of Ser. No. 035,605 filed Apr. 26, 1979, now abandoned which is a continuation-in-part of application Ser. No. 932,563 filed Aug. 10, 1978 (now abandoned).

The present invention relates generally to a golf practice device, and more particularly to a golf practice pad which includes a horizontally moveable golf ball hitting surface, resiliently positioned within a static frame. In its preferred embodiment, the frame is positioned on or adjacent to a stance mat having a raised foot placement area in order to provide a place to stand which is coplanar or level with the golf ball hitting surface. The golf practice device of the present invention is adapted for hitting either conventional golf balls or plastic golf balls for instructional or for practice purposes, either indoors or out of doors, in any environment wherein a golf club can be swung.

A variety of golf mats and other golf practice devices have been proposed by the prior art which attempt to simulate grass surface on a mat for repeated and extended golf swing practice for use at golf driving ranges. Typical of such prior art pads are stationary or fixed position mats with door-mat-like construction, some of which are overlaid with synthetic grass such as Astro turf or other brush-like bristles attached to base mats. However, such stationary (fixed position) pads attached to such mats have at least three disadvantages: (1) the "feeling" transmitted to a golfer on hitting a golf ball off such a stationary (fixed) pad is a poor simulation of the feel of hitting a golf ball under natural turf conditions, i.e., natural turf gives way and moves forward at club impact with the ball, (2) the fixed pad hitting surfaces are not coplanar with the stance area of the mat, and (3) the simulated grass surface pad, fixed on a stationary mat base, wears rapidly because it provides no pad give or movement at club impact, thus entailing expensive and frequent replacement.

Some prior art devices such as shown by U.S. Pat. No. 3,423,096 have attempted to overcome the unnatural feeling, but such pad devices which employ springs under the hitting surface require a vertical space under the hitting surface for the springs. Such devices are not adapted to being implaced readily on the golf swing practice base mats now in use; nor are they readily adaptable for use indoors on the living room floor as is the subject matter of this application.

The present invention overcomes such problems in providing a non-stationary, artificial turf hitting surface which is resiliently positioned within a static frame, which permits a natural-feeling, forward, sliding, horizontal movement of the hitting surface when the club impacts with the surface at impact with the golf ball. The golf club, as it approaches the golf ball in the swing, is moving primarily in a horizontal direction, but with slight downward component. The ideal golf shot is executed by hitting the ball first and the turf thereafter. The pad of the present invention will accommodate the horizontal component of the impact by sliding horizontally and will accommodate the downward component of the impact through compression of the fibers of the synthetic grass. The hitting surface pad is preferably held in position by elastic cords, springs or similar resilient means attached to a fixed position frame, which frame surrounds the hitting surface area. The static frame permits the entire hitting surface to slide forward in a horizontal plane when the club impacts with the ball along the line of flight of the golf ball, thus producing simulated turf conditions. The resilient means then return the hitting surface to its original position.

In the preferred embodiment, the hitting surface is held in position within the static frame by non-metallic resilient means such as a cloth-covered, elastic cord of the type known as "bungy cord". The occasional tendency of metallic spring devices to become bent, to be permanently stretched, or to be otherwise deformed may be overcome by the use of non-metallic resilient devices of appropriate size and modulus.

It has been found that the horizontally moveable hitting surface of the present invention provides a hitting surface which transmits a natural feel to the golfer, i.e., the feeling experienced by the golfer in making a proper swing at club impact with the ball taking a natural divot which occurs in a properly executed fairway iron shot. Moreover, the resiliently-mounted structure of the present invention provides a long useful life or reduced wear because the moveable, synthetic grass surface, hitting surface slides forward at club impact with the ball, thus reducing the damage caused by the club impact force against the moveable hitting surface as compared to a stationary-type mat.

The object of the present invention is to provide a golf practice device adaptable to existing mats which includes sufficient area for hitting all golf shots either indoors or outdoors and which is also readily adaptable for mounting on small mats for practicing pitch and chip shots in any environment where a golf club can be swung.

The advantages of the present invention will be more fully understood by references to the drawings, in which.

Figure 1:
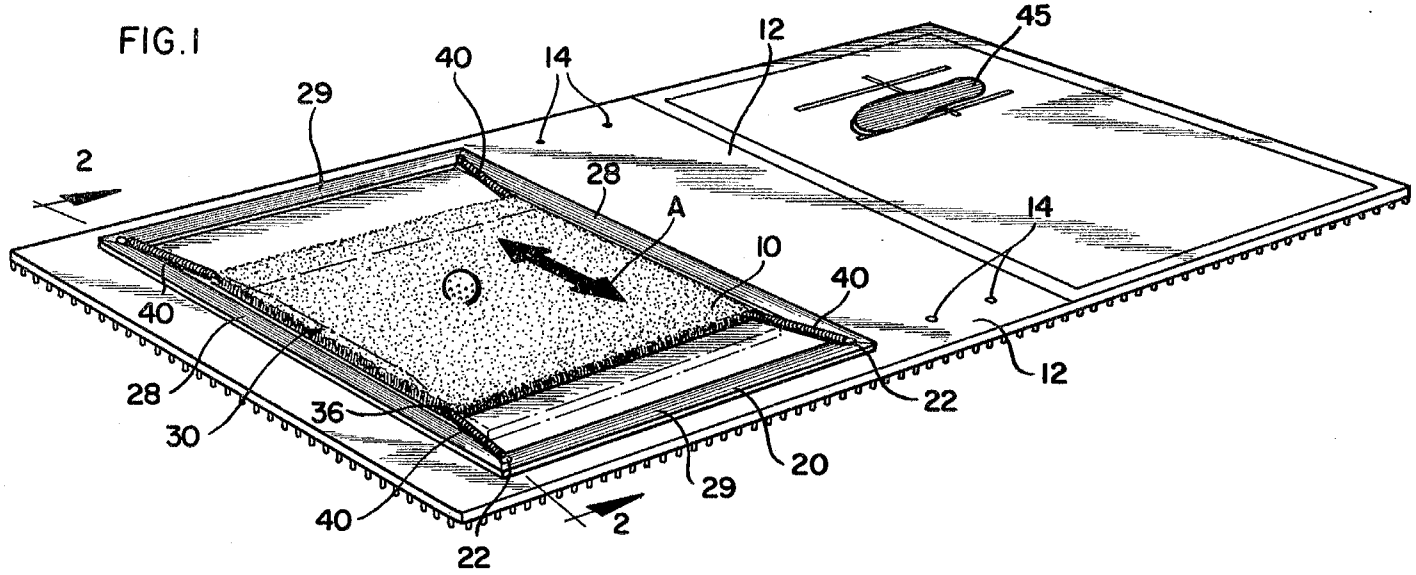
FIG. 1 is an isometric view of the improved golf practice pad with a spring positioned hitting surface mounted on a full size base mat.

The following description will enable those skilled in the art to construct the golf practice mats of the present invention, including the non-metallic resilient means suspended hitting pad and the metallic spring suspended practice pad. Where practible, the same numbers have been used in the drawings to identify the parts which are common to both embodiments.

Figure 3:
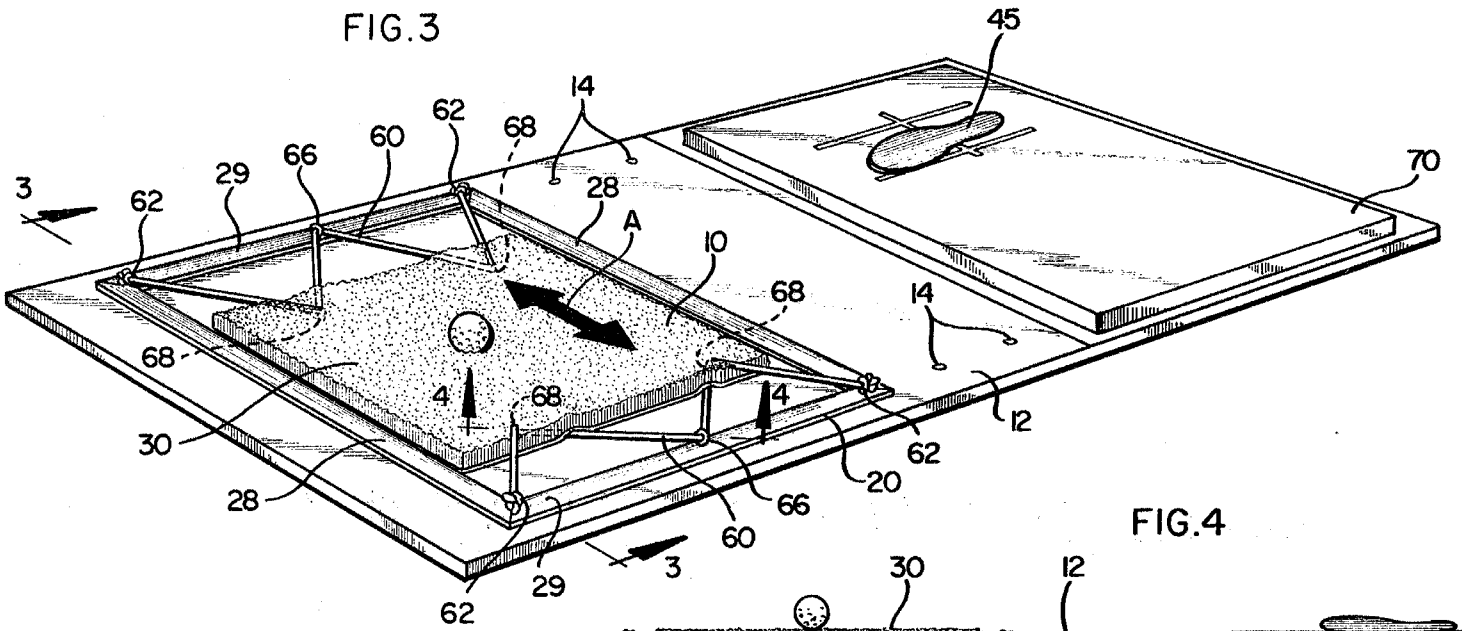
FIG. 3 is an isometric view of the preferred embodiment of the improved golf practice pad with a non-metallic resilient means connecting the hitting surface to the stationary frame which is positioned on a full size base mat.
Figure 4:
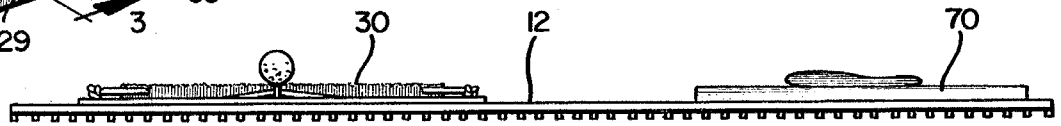
FIG. 4 is a side view of the preferred embodiment shown in FIG. 3 illustrating the relative height of the foot placement area and the ball hitting surface.

The resiliently suspended golf practice pad of the present invention is shown in FIGS. 1 and 3 generally at 10. The device generally comprises a static frame 20 and a horizontally moveable hitting surface 30 disposed within the frame and resiliently positioned therein by springs 40, or elastic members 60.

Figure 2:
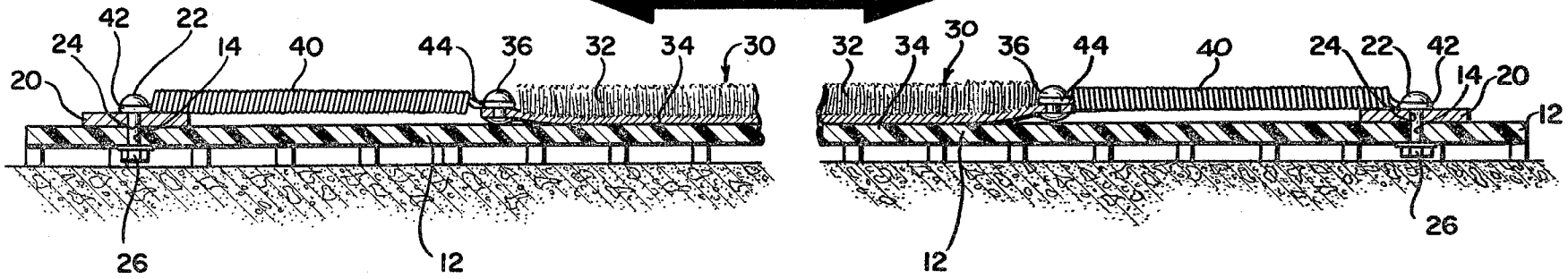
FIG. 2 is a partial side view of the improved golf practice pad shown in FIG. 1, taken in section along lines 2—2.

Having reference to FIGS. 1 and 2, frame 20 is generally rectangular in shape, although it may be square, comprising two side rails 28 and two end rails 29, and is designed to remain stationary while the golf ball is struck. Frame 20 is preferably fabricated from a metal, such as steel, but may also be fabricated from wood, plastic, or the like. Pins 22 located at the corners of frame 20 are adapted to engage holes 14 in base mat 12 to facilitate holding the frame immobile as is clearly shown in FIG. 2. The upper end of pins 22 may also serve to engage the end loop 42 of springs 40 and secure the springs 40 to the frame 20.

In the embodiment of FIGS. 1 and 2, pins 22 are threaded to engage threaded holes 24 in frame 20 and thereby hold the end loop 42 of spring 40 securely to frame 20. The threaded portion of pins 22 which extend below frame 20 are adapted to cooperate with holes 14 in base mat 12 and prevent the frame from sliding when a golf ball is struck from the mat. Preferably base mat 12 is provided with a plurality of holes 14 which are adapted to engage the pins 22 and provide for implacement of the spring suspended golf hitting areas to various positions on the surface of base mat 12 to accommodate the height, reach and stance of the user.

The present invention contemplates the use of nuts 26 to engage threaded portion of pins 22 in order to secure frame 20 to the base mat 12, although it has been found that such nuts or other securing means are not necessary to maintain frame 20 in the static position.

Referring specifically to FIGS. 3, 4, 5, and 6, the preferred embodiment of the present invention, the elastic resilient member 60 is preferably attached to front and back rails 29 at three points and attached to the horizontally moveable hitting surface 30 at two points. Those skilled in the art will understand that other arrangements may also be used. The present invention contemplates that the resilient member 60 may be an elastic cord or the like having the necessary elastomeric property. Commercially available elastic cord, which is cloth covered and which is sold under the trade name "Bungy Cord" is suitable for use in the present invention as are other types of commercially available materials.

The resilient members 60 may be conveniently attached to the corners of the frame through metallic loops 62 wherein the resilient means, i.e., elastic cord, is attached thereto through the use of knots 64. Preferably the elastic cord is threaded through loop 66 without knotting, at the mid point of back frame and front frame 29. Elastic cord 60 is threaded through aperatures 68 in hitting surface 30. The elastic cord 60 thus forms a "W" whereby hitting surface 30 is adapted to slide horizontally back and forth, along the line of flight of the golf ball, but with sufficient tension normal thereto to keep the hitting surface 30 centered within side rails 28.

Figure 7:
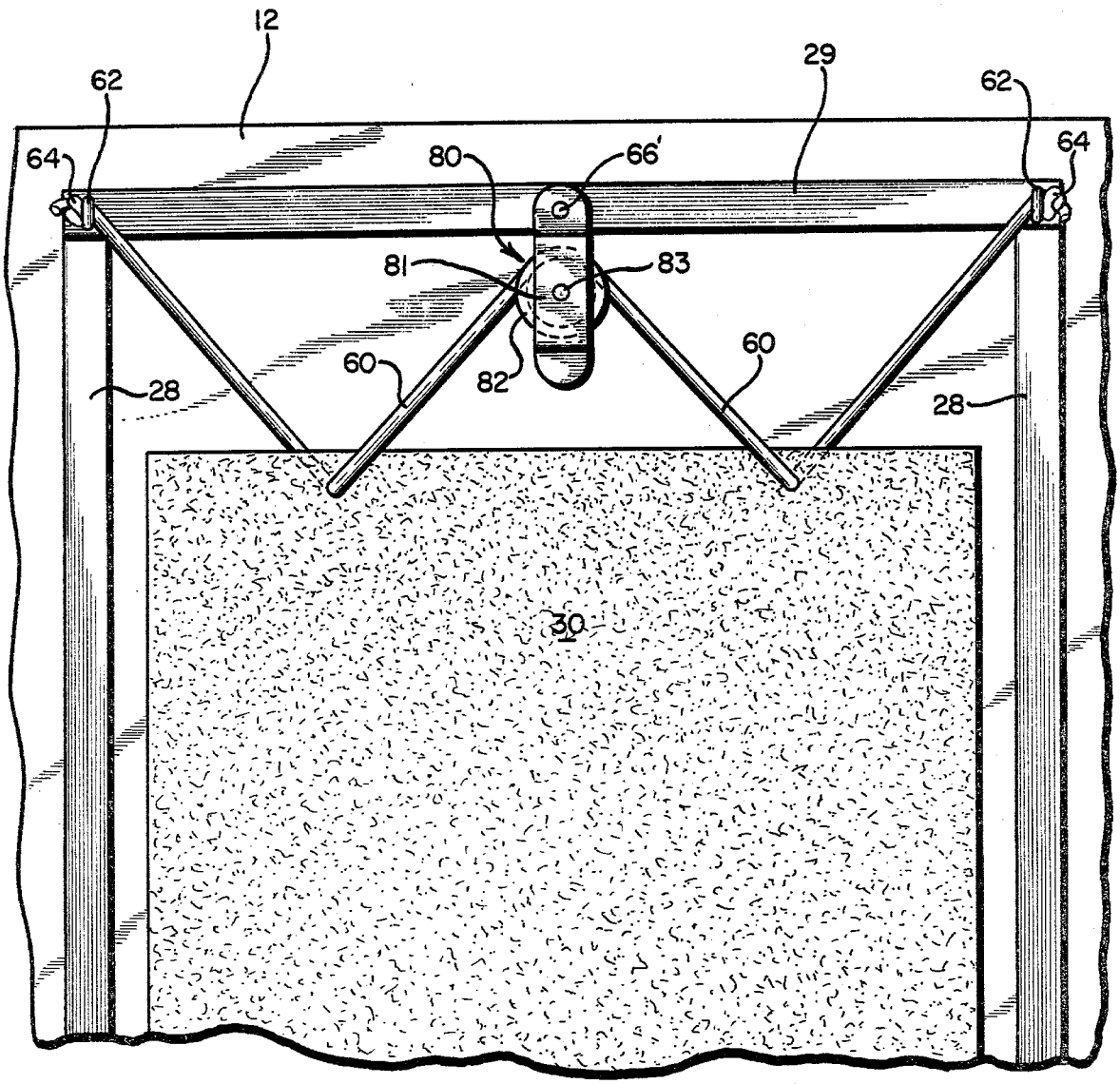
FIG. 7 is a partial top view of the most preferred embodiment comprising a pulley to slidably connect the center of the elastic cord to the frame.

In the most preferred embodiment, the elastic cord 60 is securely fastened at its end points to the stationary frame 20, but the elastic cord is slideably connected to the frame at its midpoint. As is shown in FIG. 7, a pulley 80 is attached to loop 66' and elastic cord 60 is threaded through pulley 80. It is preferred to use pulleys 80 to connect the resilient means to both the front frame member and the back frame member, but the attachment to the back frame is considered most important.

The pulley 80 comprises a frame member 81, secured to loop 66', and rotating member (pulley wheel) 82 which rotates about pin 83. The elastic cord is threaded through the pulley frame 81 and rests on rotating member (pulley wheel) 82. When a golf ball is struck from the hitting surface wherein the club is not moving at the intended line of flight, but is moving at an acute angle thereto (a swing which would ordinarily produce a hook or a slice), the hitting surface 30 has a tendency to move in the direction the club is moving, to one side or the other. In the most preferred embodiment, the pulley 80 permits the resilient means 60 to move in the direction the golf club is moving, and thus provide horizontal sliding movement of the hitting surface in he direction the club is moving. The movement of the elastic cord at its center point is accommodated by the pivoting of the pulley 80 around loop 66' and the rotation of the pulley wheel 82 within the frame 81.

It has been found that the most preferred embodiment, wherein the elastic cord 60 is slideably held at its mid-point by a pulley 80, provides the most natural feel to a golfer using the golf practice pad to the present invention. The most preferred embodiment is particularly advantageous with respect to shots which are struck "off-line" and which tend to move the hitting surface 30 either to the right or left of the intended line of flight. The use of the pulley 80 at the mid-point of the bungy cord provides a much more "natural" feel to the golfer on such occasions.

Figure 5:
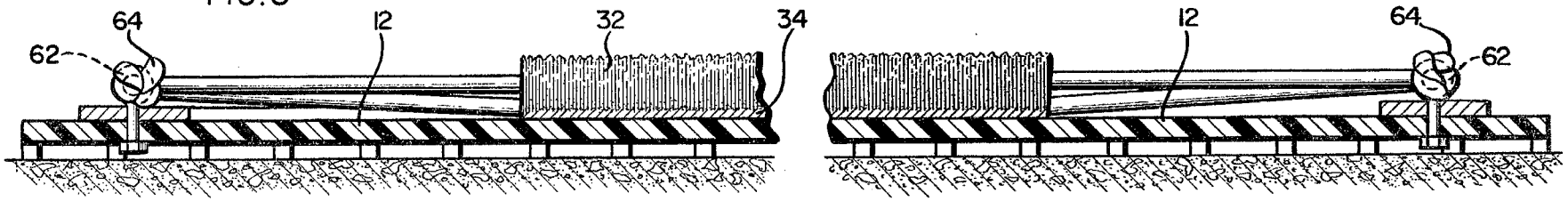
FIG. 5 is a partial end view of the golf training device of FIG. 3, taken in section along line 3—3.
Figure 6:
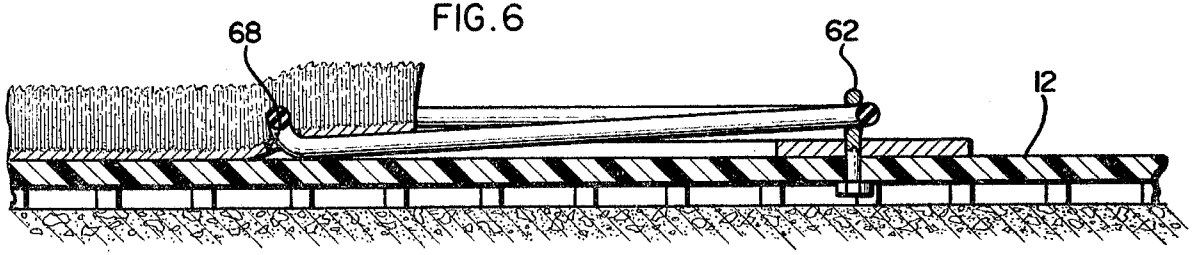
FIG. 6 is a partial oblique side view taken in section along line 4—4.

The hitting surface 30, which comprises the hitting surface for both embodiments, preferably is an artificial grass-type surface which may be composed of a wide variety of artificial grass or brush-like surfaces wherein vertically disposed leaf-like bristles 32 are affixed to horizontal base 34 in such a manner that the bristles 32 retain a vertical attitude. It is preferred that the bristles 32 be long enough to rise above any hardware portion of the practice mat 10, such as loops 66 for example. Base 34 may be sufficiently tough to retain by adhesion or other means bristles 32 when struck by a golf club. Base 34 may be constructed out of any available materials and may be either a single layer of material as shown in FIGS. 2 or 5 or a plurality of layers in order to provide the requisite strength. Preferably the lower surface of base 34 has a relatively low coefficient of friction which will permit it to move horizontally and slide over base mat 12 when struck by the golf club. It is important that hitting surface 30 be of smaller size than the overall inner dimensions of frame 20, whereby hitting surface 30 is able to move along the line of flight of the ball, as shown by arrow A, without coming in contact with frame 20.

The hitting surface 30 is disposed within the confines of frame 20 and is so maintained by resilient means, preferably springs 40 or elastic members 60 which permit the hitting surface 30 to move horizontally within frame 20. Base 34 is affixed to springs 40 through inner loop 44 and rivet 36. It is preferred that the springs 40 and the elastic members 60 be under a slight tension in order to maintain a given position of hitting surface 30 within the confines of frame 20. The size and strength of the springs 40 or the elastic members 60 may vary over wide limits. It is preferred that the springs 40 or the elastic member 60 be generally aligned with the line of flight of a golf ball as shown by arrow A, but it is preferred to position the resilient means at a small angle relative to the line of flight in order to keep the mat centered between side rails 28.

The present invention contemplates the use of the practice pad 10 with the horizontally moveable hitting surface 30 in combination with a foot placement area 70 wherein the ball hitting surface 30 and the foot placement surface are level, i.e., they are located on the same horizontal plane. The preferred co-planar disposition of the hitting surface 30 and the foot placement surface 70 may be readily seen from FIG. 4. One of the major purposes of the present invention is to provide a golfer with a device on which he can consistently practice his golf swing. In order to eliminate as many as possible variables which affect the swing, it is deemed advantageous to provide a golfer with a foot placement area which is precisely level with the ball hitting surface. The co-planar disposition, for example, permits the user to grip each club in identical position and to assume the same stance on practice shot after practice shot eliminating any necessity to variably choke down on the club which would be required if the hitting surface was higher than the height of the stance mat or area. This requires the use of a pad 10, of the type shown in FIG. 4 in order to produce a co-planar hitting area and foot placement area.

The present invention contemplates the golf practice pad of the present invention to be used in multiple sizes and varied environments, although in the preferred embodiment, the golf practice mat is employed on a larger base mat 12 as shown in FIGS. 1 and 3. Base mat 12 may be provided with a canted foot implacement device as shown in FIG. 1 at 45, and may be a golf mat of the type described in applicant's U.S. Pat. No. 4,164,352. Alternatively, the golf practice pad of the present invention may be installed on an ordinary driving range mat wherein the device may be either temporarily installed, or permanently installed, using nuts 26. Further, the golf practice pad of the present invention may be used without attachment to a base mat, i.e., by placing it on any horizontal surface. The mat 12 may be of any size, i.e., it may be of the conventional driving range size, shown in FIG. 1, wherein the golfer stands on the mat, or may be smaller, wherein the mat is about the size of frame 20, which smaller size may be used in any environment particularly for practicing with the short iron shots.

The forms of invention shown and described herein are to be considered only as illustrative. It will be apparent to thse skilled in the art that numerous modifications may be made therein without departing from the spirit of the invention or the scope of the appended claims.

I claim:

1. A golf practice pad adapted to be disposed on a horizontal surface, said pad comprising a stationary, horizontal, rectangular frame; and a golf ball hitting surface resiliently positioned within said frame; said frame comprising two side rails and two end rails, with said hitting surface disposed therebetween but spaced therefrom; resilient means adapted to maintain said hitting surface within said frame, said resilient means comprising a first resilient means connecting the front of said hitting surface to the adjacent frame; and a second resilient means connecting the back of said hitting surface to the adjacent frame; said resilient means generally aligned with the direction of the line of flight of the golf ball to be struck from said hitting surface, and adapted to permit said hitting surface to slide horizontally over said horizontal surface within said frame when a golf ball is struck from the hitting surface and thereafter return said hitting surface to its original position.

2. A golf practice pad as described in claim 1, in combination with a stationary base mat, and mounted thereon.

3. A golf practice pad as described in claim 2, which includes an elevated foot placement area having an upper surface coplanar with the upper surface of said golf ball hitting surface mounted on the said stationary base mat.

4. A golf practice pas as described in claim 1, wherein said resilient means comprises cloth-covered elastomeric rubber cords.

5. A golf practice pad as described in claim 3, wherein resilient means is attached in non-sliding contact at its ends to the adjacent frame member, and is attached to the frame at its center point in sliding relationship to said frame.

6. A golf practice pad as described in claim 5, wherein the center attachment of said resilient means to said frame comprises a pulley pivotedly attached to said frame.

7. A golf practice pad as described in claim 1, wherein said resilient means comprises a plurality of springs.

8. A golf practice pad as described in claim 7, wherein said springs are horizontally disposed.

9. A golf practice pad as described in claim 1, which includes securing means adapted to maintain said frame in a stationary position.

10. A golf practice pad as described in claim 1, wherein said hitting surface comprises a synthetic grass surface.

11. A golf practice pad as described in claim 10, wherein said hitting surface comprises synthetic grass composed of vertically disposed bristles mounted on horizontal base.

12. A golf practice pad as described in claim 1, wherein said resilient means are positioned at a small angle relative to the line of flight.

* * * * *

UNITED STATES PATENT AND TRADEMARK OFFICE

CERTIFICATE OF CORRECTION

PATENT NO. : 4,311,312

DATED : January 19, 1982

INVENTOR(S) : John P. O'Brien

It is certified that error appears in the above-identified patent and that said Letters Patent are hereby corrected as shown below:

Column 4, line 14, "he" should be --the--

Column 4, line 22, "to" second occurrence should be --of--

Column 4, line 39, "may" should be --must--

Claim 4, line 1, "pas" should be --pad--

Claim 5, line 1, number "3" should be --4--

Signed and Sealed this

*Seventeenth* Day of *August 1982*

[SEAL]

*Attest:*

GERALD J. MOSSINGHOFF

*Attesting Officer*

*Commissioner of Patents and Trademarks*